US006486455B1

(12) United States Patent
Merabet

(10) Patent No.: US 6,486,455 B1
(45) Date of Patent: Nov. 26, 2002

(54) CONTAINER FOR HEATING RAPIDLY AND EVENLY FROZEN FOODS IN A MICROWAVE OVEN

(75) Inventor: Mustapha Merabet, Blonay (CH)

(73) Assignee: Nestec S.A., Vevey (CH)

( * ) Notice: Subject to any disclaimer, the term of this patent is extended or adjusted under 35 U.S.C. 154(b) by 0 days.

(21) Appl. No.: 09/577,355

(22) Filed: May 24, 2000

(30) Foreign Application Priority Data

Jun. 11, 1999 (EP) ..... 99201870

(51) Int. Cl.[7] ..... H05B 6/80

(52) U.S. Cl. ..... 219/725; 219/728; 219/729; 219/734; 219/762; 99/DIG. 14; 426/234; 426/243

(58) Field of Search ..... 219/725, 728, 219/729, 730, 732, 734, 735, 762, 763; 99/DIG. 14; 426/107, 113, 118, 234, 241, 243

(56) References Cited

U.S. PATENT DOCUMENTS

| | | | | |
|---|---|---|---|---|
| 4,496,815 A | | 1/1985 | Jorgensen | 219/10.55 |
| 4,535,889 A | | 8/1985 | Terauds | 206/527 |
| 4,542,271 A | | 9/1985 | Tanonis et al. | 219/10.55 |
| 4,642,434 A | | 2/1987 | Cox et al. | 219/10.55 |
| 4,656,325 A | | 4/1987 | Keefer | 219/10.55 |
| 4,661,672 A | | 4/1987 | Nakanaga | 219/10.55 |
| 4,831,224 A | * | 5/1989 | Keefer | 219/728 |
| 4,888,459 A | | 12/1989 | Keefer | 219/10.55 |
| 4,927,991 A | | 5/1990 | Wendt et al. | 219/10.55 |
| 4,994,638 A | | 2/1991 | Iorns et al. | 219/10.55 |
| 5,041,295 A | | 8/1991 | Perry et al. | 426/107 |
| 5,151,568 A | | 9/1992 | Rippley | 219/10.55 |
| 5,270,502 A | | 12/1993 | Brown et al. | 219/10.55 |
| 5,310,980 A | | 5/1994 | Beckett | 219/709 |
| 5,317,118 A | * | 5/1994 | Brandberg et al. | 219/730 |
| 5,352,465 A | * | 10/1994 | Godek et al. | 219/734 |
| 5,484,984 A | | 1/1996 | Gics | 219/734 |
| 5,543,606 A | | 8/1996 | Gics | 219/730 |

FOREIGN PATENT DOCUMENTS

| | | |
|---|---|---|
| EP | 0 185 488 | 6/1985 |
| EP | 0 242 026 | 10/1987 |
| EP | 0 348 156 | 12/1989 |
| EP | 0 350 660 | 1/1990 |
| EP | 0 451 530 A2 | 10/1991 |
| EP | 0 471 969 A1 | 2/1992 |
| GB | 2 226 220 A | 6/1990 |
| WO | WO 92/03355 | 3/1992 |
| WO | WO 93/23971 | 11/1993 |

* cited by examiner

*Primary Examiner*—Philip H. Leung
(74) *Attorney, Agent, or Firm*—Winston & Strawn

(57) ABSTRACT

The present invention relates to a container for cooking food in a microwave oven. The container includes a tray having a bottom wall and a side wall that is attached to the bottom wall and extends upwardly from the bottom wall to define an interior cavity and a support means to provide support for a food product and elevate the food product with respect to the bottom wall. A continuous shielding layer is provided in the bottom wall and the side wall of the tray. The bottom wall and side wall of the tray along with the bottom of the food product define a free space under the food product that totally reflects microwave beams that pass through the food product back in the direction of the food product. The container of the invention reduces the formation of temperature gradients in the food product when it is heated and accelerates the microwave reheating of the food product. The container is particularly useful for reheating large blocks of frozen food.

25 Claims, 11 Drawing Sheets

CONTAINER FOR HEATING RAPIDLY AND EVENLY FROZEN FOODS IN A MICROWAVE OVEN

FIELD OF THE INVENTION

The present invention relates to a container for reheating frozen food products in a microwave oven. The invention is particularly useful for reheating large size frozen meals that typically require excessively long heating times.

BACKGROUND AND PRIOR ART OF THE INVENTION

The long length of time required to reheat large size frozen meals in a microwave oven is a real concern in the food service and catering business. For individual portions or small size frozen meals, reheating in a domestic microwave oven, can be carried out in a relatively short period of time, generally in the range of 2 to 6 minutes, depending on such factors as, for example, the type of foods, the size of the food components, and the lay-out of the various food components in the tray. For large size frozen meals, however, microwave reheating has proven to be excessively long, for example, up to 30 minutes. These long reheating times for large frozen meals renders the use of microwave ovens less attractive.

Another problem with re-heating frozen products in a microwave oven is that temperature gradients occur in the food when it is reheated in most known containers. Before the food product is thawed, the frozen product is essentially transparent to microwaves so that the microwaves are only absorbed at a very low rate, or not absorbed at all. When a frozen product is reheated in a regular microwave transparent container the microwave energy is not properly absorbed by the frozen mass. Instead the major portion of the energy is concentrated at the interface region where the container contacts the frozen product. This uneven energy distribution is not equalized by convection heat transfer and results in excessive heating at the edges of the container with the core of the frozen mass remaining at a very low temperature. The microwave heating pattern of a large frozen dish is generally characterized by the presence of large cold spots in the center of the upper surface, by a very late thawing of the inner parts of the product, and by overheating at the edges and corners of the product.

EP 348 156 to Hewitt relates to an improvement in microwave heating wherein a microwave mode is generated from underneath the food product. The food product is disposed in a tray that is transparent to microwaves and the tray is placed on a stand so that a predetermined elevation is maintained between the bottom surface of the food product and the internal bottom surface of the stand. Heating from underneath occurs by placing separated electrically conductive plates at the bottom of the stand which are made of a microwave transparent material, or by making apertures in the electrically conductive bottom of the supporting stand. The purpose is to have a majority of the microwave energy enter through the undersurface of the container and maximize the bottom heating effect.

EP 185 488 to Sugisawa discloses a container, made of a material that is transparent to microwaves for use in a microwave oven. The container has a microwave reflecting strip that partly covers the region of the container where the upper surface of the material contacts the side of the container to prevent local over-heating of the food product. The container, however, brings no significant improvements in reheating of frozen foods and simply proposes a solution to the problem of local burning at the edges of the product when the product is reheated in a conventional transparent container.

EP 471 969 to Payne relates to the use of a microwave susceptor sleeve for pizza and the like onto which the food items are placed. The susceptor, with the food product on it, is placed on a supporting base. The supporting base is elevated with respect to the bottom of the microwave oven by the use of pre-cut legs. The elevation of the base supporting the susceptor is dictated by the need to separate the susceptor from the bottom of the microwave oven sole (i.e., the bottom surface of the oven cavity) to eliminate the risk of arcing when the oven does not have a glass shelf.

WO 93 23971 A to the Campbell Soup Company relates to a microwave metallic container wherein the bottom and the whole lateral walls are externally insulated using a polymeric or glass thin layer that completely isolates the container from the metallic parts of the microwave oven. The main features of the container are that it prevents arcing by insulating the aluminum inner tray. For better convenience and for a better heat distribution within foodstuffs that do not retain their initial shape, such as liquid foodstuffs, the bottom of the aluminum container may be slightly raised or domed so that the thickness of the product in the center of the container is reduced, since it is predominately the center of the product that has a cold spot upon microwave heating. Variations in the thickness of foodstuffs are, however, generally undesirable as it might create problems when removing the foodstuff from the container. In particular, the center of the foodstuff becomes more fragile than the periphery and this may lead to portions of the foodstuff breaking off when the foodstuff is removed from the tray. The slanted bottom of the tray also results in a more acute angle between the bottom and the sidewalls of the tray that further renders it more difficult to remove the foodstuff from the tray. Finally although the thickness of the foodstuff to be heated is reduced in the center part of the tray, the slanted bottom portion of the domed tray has a tendency to reflect the microwaves in an upward diverging direction and away from the center which causes a reduction in the microwave absorption in the center part of the foodstuff, and consequently cold spots in the center part of the foodstuff.

U.S. Pat. No. 5,310,980 to Beckett discloses the incorporation of metallic patches on a microwave transparent tray in order to orient the impinging microwave energy beams selectively towards parts of the product that do not heat-up appropriately.

EP 350 660 A2 to Jaeger relates to a susceptor sheet with a microwave transparent packaging.

U.S. Pat. No. 4,642,434 to Cox et al. relates to a microwave reflecting energy concentrating spacer that includes in its lower part a microwave reflector separated from the food base by a distance of about ¼of a wave length, i.e., about 3 cm, since the free space wave length at the microwave emitted frequency in the microwave oven (2.45 GHz) is about 12 cm.

EP 242 026 A2 to Swiontek discloses an assembly between a susceptor which is described as a "microwave interactive layer" and the whole package.

U.S. Pat. No. 4,656,325 to Keefer refers to "cold susceptors" by placing metallic patches disposed in a regular array on the cover of a pan containing the food product.

U.S. Pat. No. 4,888,459 to Keefer also refers to "cold susceptors" in addition to optimizing the thickness and the dielectric permittivity of the material constituting the non-reflecting part.

U.S. Pat. No. 5,270,502 to Brown et al. relates to a combination of a microwave interactive layer that is in fact a susceptor and a supporting stand made of a microwave transparent material.

WO 95 24 110 to Gics relates to an ovenable food package comprising a microwave susceptor placed beneath the food base in order to induce crispiness in the food base.

U.S. Pat. No. 4,496,815 to Jorgensen relates to a microwave browning utensil comprising a metallic base with a ferrite layer that is a highly microwave absorbing material.

U.S. Pat. No. 4,542,271 to Tanonis et al. relates to a microwave tray comprising an absorbing material placed beneath the bottom surface of the tray.

U.S. Pat. No. 4,927,991 to Wendt et al. relates to a microwave oven package comprising a combination of a grid and susceptors inside a microwave-transparent tray that behaves like a conventional frying pan as it is heated by microwave radiation that passes through the tray.

EP-A-0 451 530 to Peleg proposes to combine a susceptor sheet and a layer of heat absorbing material to control the heat flux to the bottom surface of the food product that is placed on the arrangement.

GB 2 226 220 to Mason discloses to a microwave-transparent tray with a microwave-transparent planar insert that raises the food product with respect to the tray bottom so that excess water and the fat from the food product may be collected into the base of the container below the supporting board.

U.S. Pat. No. 5,151,568 to Rippley is similar to the previous document with a corrugated wall placed on the bottom of the tray, instead of a planar insert. An absorbing material may be placed underneath the corrugated wall. Both the container and the corrugated wall are made of stiff paperboard material that is transparent to microwaves. The apertures in the corrugated allow liquids released by the food product during the heating to drain.

U.S. Pat. No. 5,041,295 to Perry et al. discloses a device made of a susceptor sheet and a thermal insulating pad or a rigid supporting layer so that the susceptor is thermally insulated from the bottom surface of the microwave oven.

WO 92 03355 to Guillot relates to a packaging device made completely of plastic having the general form of a container with a bottom and a sidewall. The plastic container and its lid are assembled in a snap-fitting arrangement.

U.S. Pat. No. 4,661,672 to Nakanaga discloses a container made of microwave-transparent material, the bottom surface of which is maintained at a prescribed elevation with respect to the floor of the oven, and a metallic device which is placed on the upper part of the food product in the container to control the uniformity of heating by preventing the upper parts and the edges of the food product from overheating.

Other prior art documents on microwave packaging are U.S. Pat. Nos. 4,994,638 and 4,535,889.

There remains a need for a container to cook frozen food products in a microwave oven that promotes a uniform and efficient distribution of heat within the product and avoids temperature gradients within the product after it is heated. There is also a need for a container that accelerates the microwave reheating of frozen food products, in particular, large blocks of frozen food.

SUMMARY OF THE INVENTION

The present invention is directed to a container for cooking food in a microwave oven. The container includes a tray having a bottom wall and a continuous side wall attached to the bottom wall and extending upwardly from the bottom wall, wherein the bottom wall and side wall define an interior cavity. The container also includes a support means made of a material that is substantially transparent to microwave radiation to support a food having a top surface and a bottom surface in the interior cavity. The food is supported in an elevated position above the bottom wall so that the bottom surface of the food is nearest to the bottom wall and the bottom surface of the food and the bottom wall are separated by a distance. The bottom wall of the tray, the bottom of the food, and at least part of the side wall defines a free space underneath the food, wherein the bottom wall and at least that part of the side wall that defines the free space are constructed to reflect substantially all microwave radiation that passes through the food back toward the food.

The side wall can extend upwardly above the free space at least to the upper surface of the food and is constructed to reflect microwave radiation to more quickly and uniformly heat the food.

The container may have a lid. The lid may be made of a material that is transparent to microwave radiation. At least a portion of the lid may be adapted to serve as the support means after the container has been opened. The lid may include a flat member and a peripheral edge that extends downwardly from the flat member and fits inside the interior cavity with the peripheral edge contacting the bottom wall of the container. The lid may include a flat member, a peripheral edge that extends downwardly from the flat member so that it forms a cavity for receiving the food when it is turned upside down, and a side edge associated with the peripheral edge and protruding outwardly from the cavity so that the side edge abuts with and is supported by the side wall of the tray and the flat member of the lid and the bottom wall are separated by a distance to provide the free space when the lid is turned upside down and placed in the tray.

The distance between the bottom surface of the food and the bottom wall may be at least about 2 millimeters but less than about 20 mm. The bottom wall and side wall part that defines the free space may constructed of a metallic material such as aluminum or an aluminum alloy. The tray may be a single unit made entirely of a metallic material that reflects microwave radiation. The tray may also be in a multilayer arrangement with at least one layer being a metallic layer that reflects microwave radiation.

The support means may be a flat member for receiving the food and at least one spacing member between the bottom wall and the flat member. In one embodiment there are a plurality of spacing members which are substantially evenly distributed and attached to the flat member. In another embodiment the at least one spacing member may be attached to the tray. The spacing member may also be a peripheral shoulder on the side wall directed toward the interior cavity onto which the flat member is positioned or a plurality of glass or plastic marbles that directly contacts the food. The support means may be collapsible and may be an inflatable bag having a series of air cells that define interior channels that can be inflated with air before cooking.

The side wall of the container may have one or more corners that are angled and further include a microwave opaque material that spans the side walls at the corners to concentrate the microwave radiation in the corners. The container may have a lid to provide the opaque material wherein the lid has a main central portion made of a material that is transparent to microwave radiation and microwave opaque portions are attached thereto. The container may have a cavity that is at least about 1 liter, and wherein the entire sidewall is constructed to reflect microwave radiation.

In one embodiment of the container the tray is a lid that in one position covers the support means and the food and in an inverted position forms the free space beneath the food. The support means may include a side wall to form the interior cavity and be configured to have a smaller periphery that than the side wall of the lid, and include spacer means for limiting the depth that the support means can be inserted into the lid. The spacer means may be a shoulder associated with one of the side walls.

The invention is also directed to a method for uniform microwave heating of food. The method involves providing a food having a top surface and a bottom surface, placing the food on a support means that is made of a material that is substantially transparent to microwave radiation, providing a free space beneath the bottom surface of the food wherein the bottom surface of the food wherein the bottom surface of the food is separated from a bottom surface of the free space by a distance and the free space is constructed to reflect substantially all microwave radiation that passes through the food back toward the food, and exposing the food to microwave radiation for a sufficient time to cook the food. The food product may be a frozen food product. The distance between the bottom surface of the food and the bottom surface of the free space may be between about 2 and 20 mm and the thickness of the frozen food product may be between about 28 and 60 mm. The support means may be surrounded by a side wall that has corners and the method may further include providing a microwave opaque material that spans the corners of the side wall to concentrate the microwave radiation in the corners.

BRIEF DESCRIPTION OF THE DRAWINGS

FIG. 7B illustrates a cross sectional view of another embodiment of the lid for the container of FIG. 7;

DESCRIPTION OF THE PREFERRED EMBODIMENTS

Figure 1:
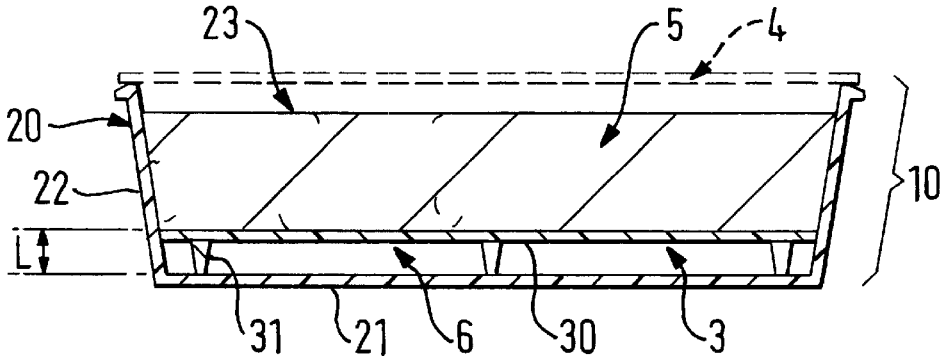
FIG. 1 is a vertical cross sectional view of a container according to a first embodiment of the invention.

The invention relates to a container for heating a food product in a microwave oven that promotes a uniform and efficient distribution of heat within the food product, minimizes temperature gradients in the heated food product, and accelerates the microwave reheating of frozen food products. The invention is particularly useful for heating large size blocks of frozen food. The container of the invention is depicted in FIG. 1. The container 10 comprises a tray 20, which has a substantially planar bottom wall 21 and a side or peripheral wall 22 extending upwardly from the bottom wall 21. The conjunction of the bottom wall and sidewall defines an interior cavity 23 that optionally can be, closed with a lid 4, as shown in dotted lines. Preferably, the lid is removed before the container is inserted in the microwave oven. When the lid is non-removable, the lid is made of a suitable material that is transparent to microwaves. Such transparent materials include, but are not limited to, plastic, cellulose, ceramic, and fiberglass materials. It is important to note that the container of the invention needs to offer a relatively wide microwave transparent upper surface or window so that the food product can be properly exposed to the microwave energy. The exposed surface area of the food product may extend from about 100 $cm^2$ for small size food products up to about 800 $cm^2$ for large size products. Preferably, the exposed surface area of the food product is between about 200 $cm^2$ and 600 $cm^2$, more preferably between about 350 $cm^2$ and 480 $cm^2$.

Figure 3:
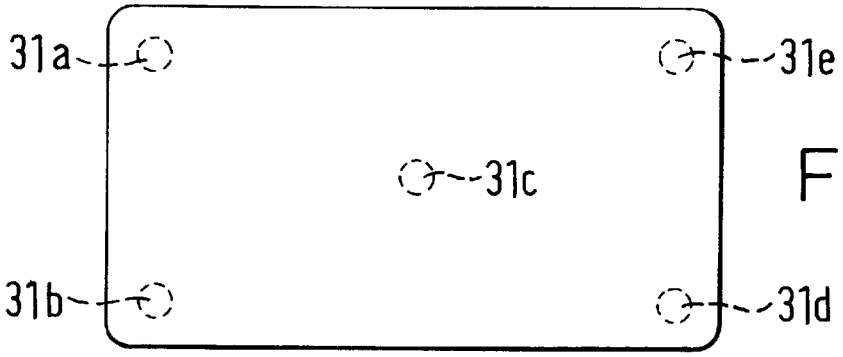
FIG. 3 is a bottom view of the container according to FIG. 1.

Within the cavity 23 of the tray is positioned a support means 3 that supports the food product 5. Preferably, the support means has a plate-like portion 30 that supports the food product 5. As shown in FIGS. 1 and 3, the plate-like portion is spaced from the interior surface 210 of the bottom wall 21 by means of a series of spacing members 31, 31*a*, 31*b*, 31*c*, 31*d*, and 31*e*. Preferably, the spacing members are evenly distributed under the plate-like portion 30 so as to avoid any unbalanced positioning of the food product and to ensure a relatively constant vertical distance L between the food product and the bottom wall. The spacing members 31 *a–e* are preferably attached to the plate-like portion 30. Preferably, the spacing members 31*a–e* are made unitary with the plate-like portion 30. Alternatively, the spacing members may be unitary with the bottom wall 21.

The support means can be made of any suitable microwave transparent materials that are sufficiently rigid to properly support the food product 5. For example, plastic, cardboard, ceramic, fiberglass, glass, or any suitable combinations thereof can be used. Metallic materials are excluded, as the beams would not reach the free space 6 but would be reflected toward the food product at the wrong incidence angle.

An important feature of the invention is that the tray 20 comprises a continuous shielding layer that defines the free space 6 and permits the reflection of the microwave beams toward the food product with a reduced amount of nonabsorbed microwave energy. Preferably, the continuous shielding layer extends upwardly along the sidewall at least beyond the region where the upper surface 7 of the food product contacts the sidewall. Thus, the sides of the container are properly shielded so that they reflect and concentrate a maximum amount of microwave energy within the cavity. In the present context "continuous" means that the layer is free of any apertures which could allow the beams to escape or would allow the beams to enter from underneath the container and consequently modify the heating pattern in an unsuitable way. Thus, the sides of the container reflect substantially all the microwave radiation, i.e., at least about 70 percent, preferably at least about 80 percent, and more preferably at least about 90 percent of the radiation is reflected.

It has been surprisingly found that a mode of total reflection of the microwave radiation is obtained, wherein the radiation is reflected within the food product, when the food product is elevated and a laterally and horizontally defined free space is provided under the food product that reflects the microwave radiation. It has also been found that the energy reflected back by the container's cavity toward the microwave source, i.e., the energy that was not absorbed by the product and would typically be lost, is significantly reduced compared to the prior art containers. The container of the invention induces an improved coupling between the microwave radiation and the food product wherein most of the available microwave energy is absorbed by the food product instead of being lost by reflection back toward the generator so that rapid heating of the food product takes place. The container of the invention also provides a more homogeneous distribution of microwave energy within the food product and results in the food product thawing and heating more rapidly without cold spots. The free space is an important aspect of the invention and provides a much more uniform heat distribution within the food product with lowered temperature gradients. Therefore, contrary to the numerous prior art on "susceptor patches," such as disclosed in EP 348 156, for example, the present invention confines the microwave fields into the product in the tray by shielding the bottom of the tray and at least part of the sides of the tray. The presence of apertures in the tray would completely destroy the microwave pattern in the food product and would reduce the substantial increase in the microwave energy absorbed by the food product that is observed with the container of the invention.

Figure 1A:
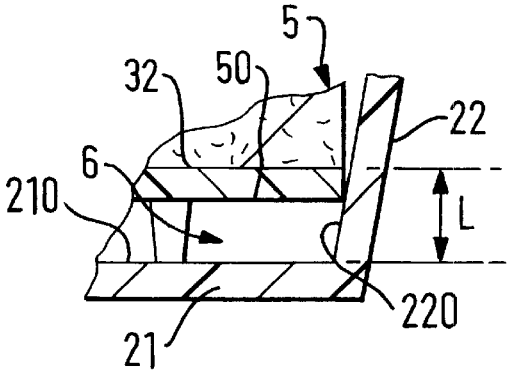
FIG. 1A is an enlarged detailed view of a partial section of the container of FIG. 1.

In FIGS. 1 and 1A, the tray is made entirely of a monolithic material that reflects microwave radiation. For reasons of cost and ease of construction the tray is preferably made of a single piece material. By reflecting material is meant any material that reflects at least about 90 percent of the microwave energy that impinges on its surface. Preferably, the material is aluminum or an aluminum alloy. This continuous integral shielding arrangement provide an intense and total reflection of the microwaves both laterally and underneath of the food product with no risk of overheating the edges of the food product as occurs in a conventional microwave tray. As shown by FIG. 1A, the free space 6 is externally and continuously defined horizontally by the reflective interior bottom surface 210 and laterally by the reflective interior surface 220 of the sidewall.

Figure 1B:
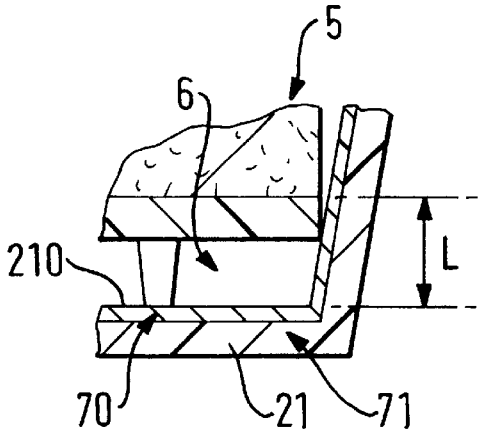
FIG. 1B is an enlarged detailed view of a partial section of the container of FIG. 1.
Figure 2:
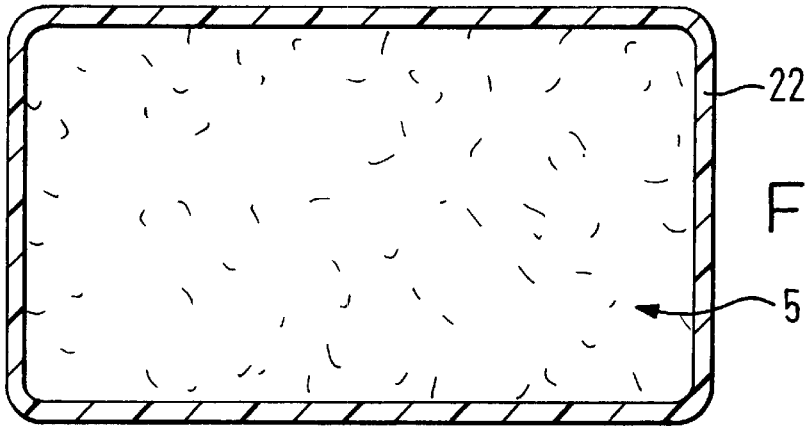
FIG. 2 is a top view of the container according to FIG. 1.

FIG. 1B shows another embodiment of the invention wherein the shielding layer is a separate layer 70 coated onto a rigid frame 71 of the tray. Thus, the tray can be made in a multi-layered or laminate arrangement having combinations of shielding and microwave transparent layers. At least one layer in the multi-layered arrangement is a continuous layer which is impervious to microwave radiation. Layer 70 can be, for example, a metallic layer, preferably aluminum or an aluminum alloy. In FIG. 1B, the shielding layer 70 is the internal layer and the rigid layer 71 is the external layer. Shielding layer 70, however, could also be positioned as the outermost layer of the tray or as an intermediate layer between two transparent layers of the tray. The reflective layer can contemplate a wide range of stiffness from very flexible to very rigid.

In the present description, the reference to a free space 6 is understood to be the space defined vertically by the vertical distance L provided between the surface of the continuous non-transparent shielding layer of the bottom wall 21 and the bottom surface 50 of the frozen food product. Typically, the bottom surface 50 of the food product is adjacent to the upper surface 32 of the plate-like portion so that the vertical distance can be considered as the distance L between the non-transparent shielding layer and the upper surface 32 of the plate-like portion 30. The vertical distance is at least about 2 mm. Preferably, the vertical distance is between about 5 and 20 mm. If the elevation of the food product is insufficient, the microwaves penetrating the product from the top surface propagate through the product until they reach the internal bottom surface of the product, and then are reflected back, however, the microwaves are reflected under conditions that provide only a very small chance that the microwaves will be absorbed by the product because of the inappropriate angle of incidence of the microwaves within the food product. The range for L represents the optimum elevation of the food product with respect to the continuous shielding layer at the bottom of the container so that most of the microwave energy remains within the product through multiple internal reflections between the upper and the lower surfaces of the food product. Surprisingly, it has been found that within the defined range for L, the heating rate before the product thaws, i.e., during the period the product is usually less inclined to absorb energy, as previously discussed, is increased by about 50 to 80% due to the under-heating effect and the multiple internal reflective pattern.

The free space 6 is also defined horizontally by the sidewalls of the tray, more particularly, by the shielding layer of the sidewall. The bottom surface of the tray and the sidewalls of the tray along with the bottom surface of the food product 5 define a continuous free space 6 underneath the food product in the sense that substantially no microwave radiation can enter or leave the free space 6 in either the horizontal or downward directions.

Figure 8:
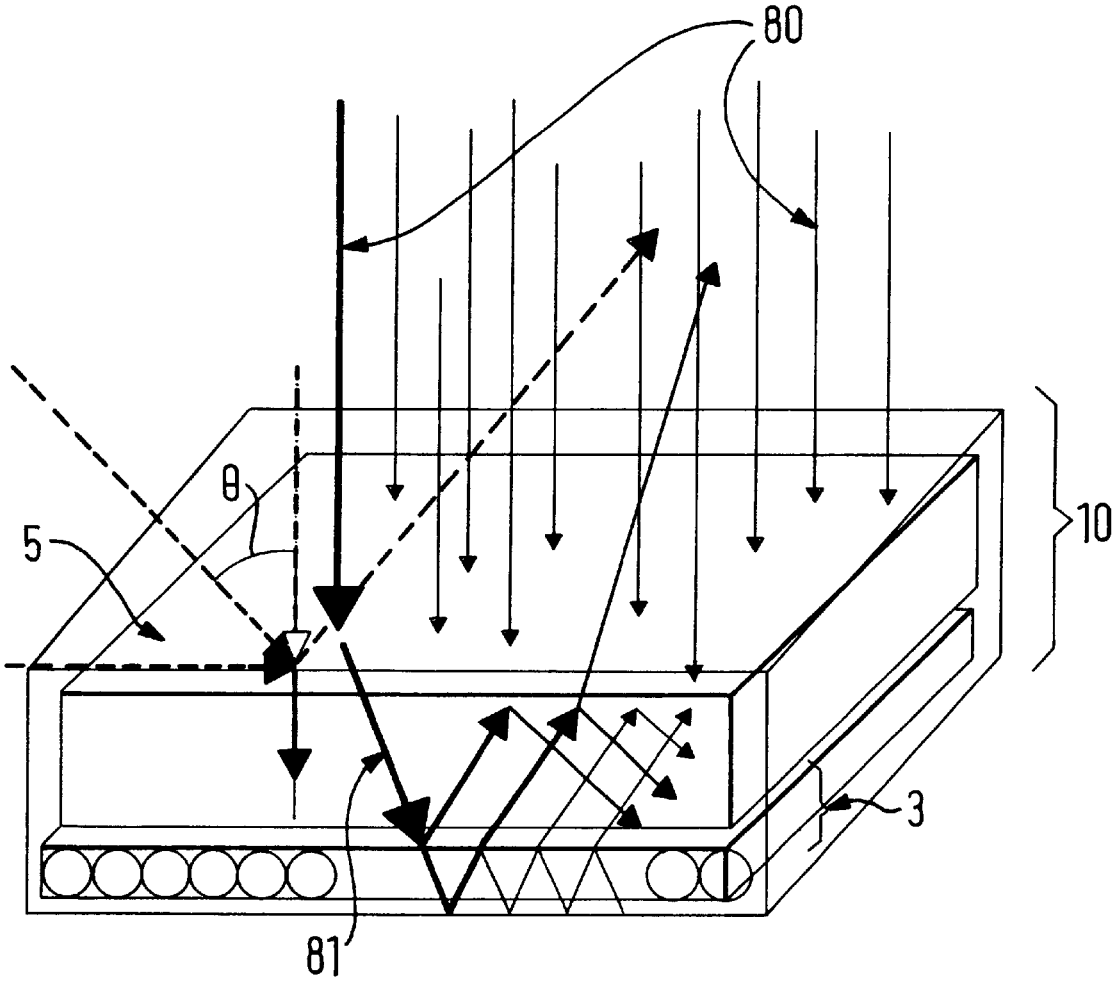
FIG. 8 is a diagrammatic view showing the propagation of microwaves according to the principle of the invention.

Microwaves propagate in any non-metallic medium and the amplitude and the propagating direction are affected when the microwaves cross the interface between two media having different electrical properties. When microwaves encounter such interfaces, a part of the impinging waves are reflected back while the remaining microwaves propagate into the second media but at a different angle. This bending of the wave fronts at the interface is known as refraction. FIG. 8 shows the pattern of interactions of the microwaves with the food product in the context of the invention. As depicted in FIG. 8, the initial microwave radiations 80 generated by a microwave source such as an assembly comprising a magnetron and a wave guide (not represented), are directed toward the food product from above the container. As the radiation beams encounter the food product the beams are refracted leading to a refracted radiation component 81 within the food product and a reflected component 88.

Refraction is characterized by a change in the angle of the propagating direction and the amplitude of the microwaves being modified. Snell's Law gives the relationship between the angle of incidence and the angle of the refracted beam. Fresnel's equations describe the amplitude damping of the reflected and refracted beams with respect to the incident beam. Conventionally, the angle of incidence and the angle of refraction are measured with respect to an axis that is vertical to the plane of the interface. Thus, a zero angle of incidence describes a "normal" beam, i.e., a beam perpendicular to the interface. For a given angle of incidence, the angle of refraction is larger or smaller depending on the dielectric permittivites of the two media. The angle of refraction is larger (smaller) than the angle of incidence if the medium of refraction has a dielectric permittivity that is smaller (larger) than that of the medium for the incident wave. In fact, the larger angle is always in the medium of lower dielectric permittivity. In the microwave tray of the invention, microwave beams propagate in air (in the oven cavity) until reaching the top surface of the food product contained in the tray of the invention. Part of the impinging microwaves 82 are reflected back 88 with an angle θ equal and symmetric to the angle of incidence. The remaining microwaves 80 are refracted in the food product 81 with a smaller angle since the dielectric permittivity of the food is larger than the dielectric permittivity of air. These refracted beams propagate into the product and reach the bottom surface of the food product where again they are split into reflected beams 84 into the food product and refracted beams 85 into the free space between the bottom of the food product and internal metallic surface of the tray. These refracted microwave beams bounce off the internal metallic surface and strike the food product from underneath with a new configuration of reflected beams 86 and refracted beams 87. The important feature of the invention is that the "secondary" beams, i.e., the beams that have already passed the food product once and are now propagating from below the food product towards the top of the food product, i.e., 84 and 87. As the waves propagate from the medium of larger permittivity towards air, the permittivity of which is about unity, there is a limit to the angle of incidence above which there is no beam transmission to the other medium, i.e., the air. This situation is referred to as "total reflection," and results in the microwave beams being trapped in the food product since the total reflection is reproduced at the internal top and internal bottom surfaces of the food product.

The limit angle $\Theta_{lim}$ for total refection can be calculated from Snell's Law, given by $$\sin(\Theta_{lim})=(\in'_2/\in'_1)^{1/2}$$

wherein $\in_2$ is the dielectric permittivity of the second medium, i.e, air in the present case and, thus, equals about 1, and $\in'_1$ is the dielectric permittivity of the medium of the incident wave, i.e., in this case the permittivity of the frozen food product. For example, if the frozen food product is at −18° C. and the microwave heating frequency is 2.45 GHz the dielectric permittivity of the food product is about 3.2 so that the limit angle $\Theta_{lim}$ is given by $$\Theta_{lim}=\text{arc}\sin(1/3.2)^{1/2}$$

that corresponds to $\Theta_{lim}$=34°. This means that all the "secondary" beams that have an angle of incidence higher than 34°, i.e., those from 90° to 34°, will be totally reflected and trapped in the food product. The amount of internally reflected radiation depends on the thickness of the free space underneath the food product as well as the thickness of the product and dielectric properties of the food product. It is possible to obtain substantially complete internally reflected radiation at the interface between the upper face of the product and the air. Preferably at least 60 to 70 percent of the microwave radiation is absorbed by the food product.

In addition, as the temperature of the food product begins to increase the dielectric permittivity of the food product also increases and thus the limit angle, $\Theta_{lim}$, decreases so that the range of incidence angles that lead to total reflection increases. As the product heats up more and more of the microwave beams are trapped in the food product resulting in an acceleration of the heating rate.

Figure 4:
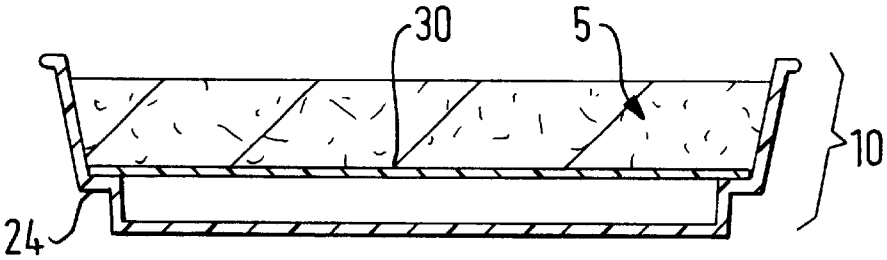
FIG. 4 is a vertical cross sectional view according to a second embodiment of the invention.
Figure 4A:
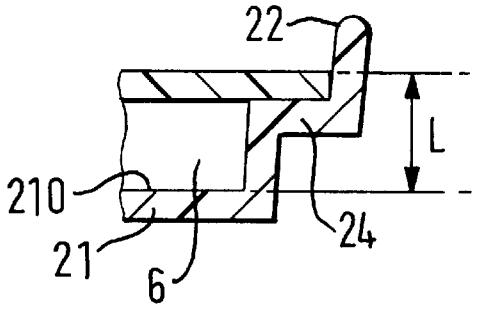
FIG. 4A is an enlarged detailed view of a partial section of the container of FIG. 4.
Figure 5:
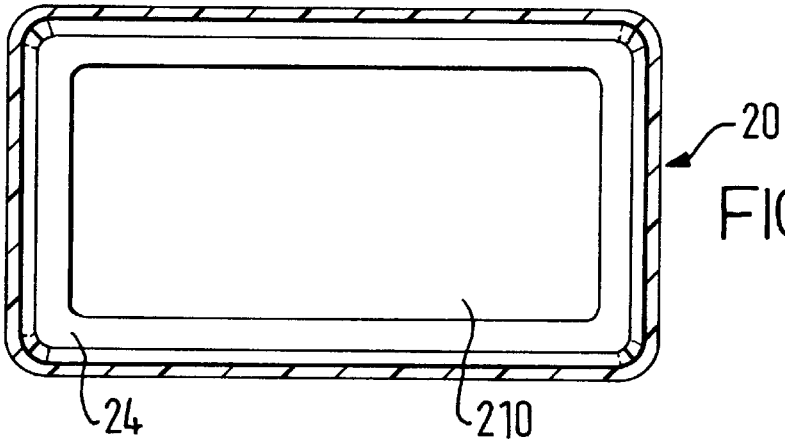
FIG. 5 is a top view of the container of FIG. 4.

FIGS. 4, 4A, and 5 show another embodiment of the container wherein the spacing member is part of the tray. In this embodiment the spacing member forms a peripheral shoulder 24 directed towards the interior cavity 23 onto which the plate-like portion 30 is positioned. The shoulder may be either continuous or made of discrete shoulder portions, provided the plate-like portion is in a static arrangement over the free space 6 so that the vertical distance L is substantially constant. Additional spacing members can also be added to prevent the plate-like portion 30 from flexing in the middle of the tray. Flexing of the plate-like portion 30 would make the vertical distance non-constant and consequently, would modify the heating regime in the middle of the food product compared to the edges of the food product.

Figure 6:
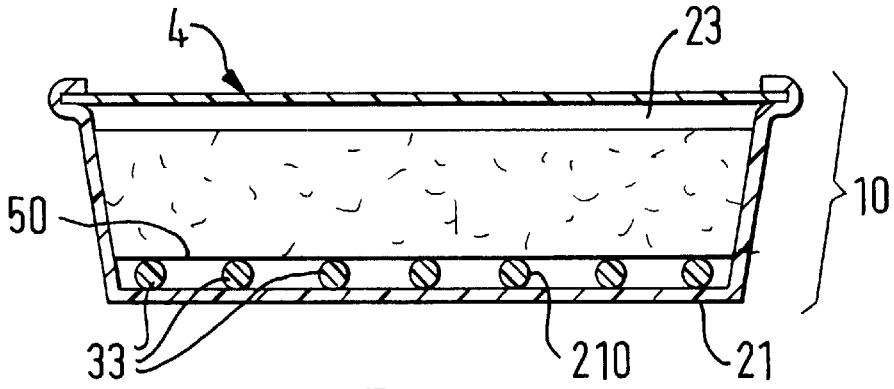
FIG. 6 is a vertical cross sectional view of a container according to a third embodiment of the invention.

FIG. 6 illustrates another embodiment of the invention. In this embodiment the spacing means comprises a plurality of marbles made of microwave transparent-materials 33 distributed on the surface 210 of the bottom wall of the tray. The marbles directly contact the bottom surface 50 of the food product. For example, glass or plastic marbles can be used. This embodiment is generally not convenient for commercial use since the food, if partly flowable, would mix with the marbles after thawing. This embodiment, however, is useful in foods that are not flowable.

Figure 7:
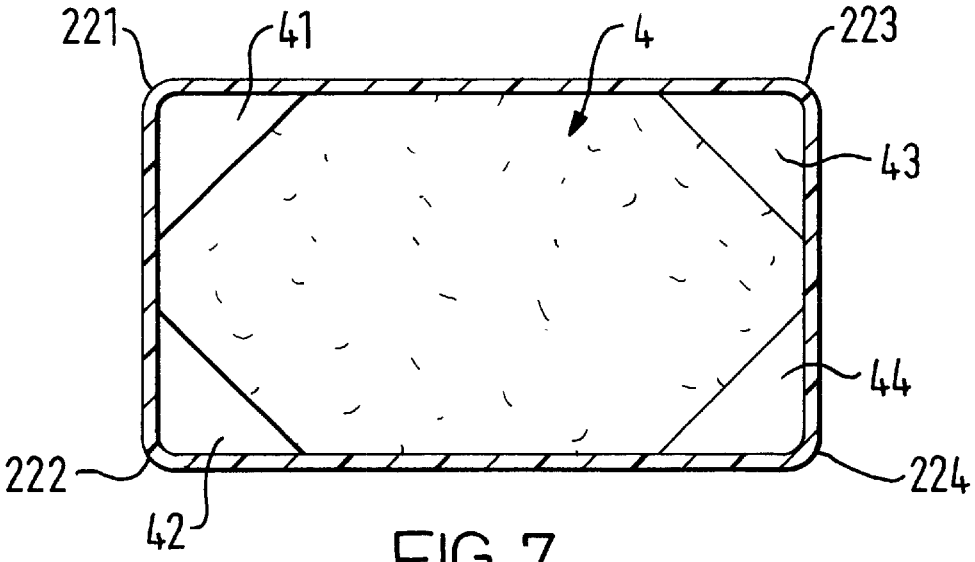
FIG. 7 is a top view of a container of another embodiment of the invention.
Figure 7A:
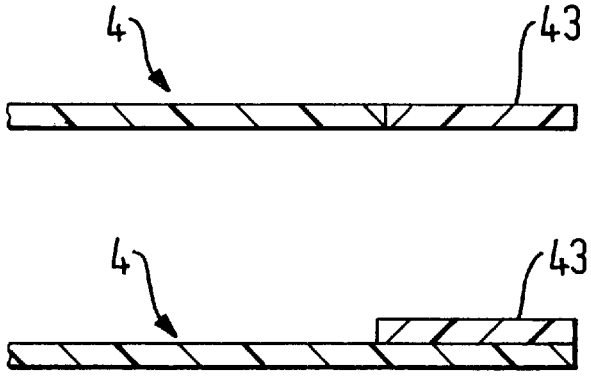
FIG. 7A illustrates a cross sectional view of a lid for the container of FIG. 7.

According to the invention, the container may have any shape including, but not limited to, a rectangular, square, round, or polygonal sided tray. In trays with a high capacity to reflect microwaves, such as those of the invention, if the side walls of the tray are angled at the corners the corner regions may require a higher concentration of microwave radiation to allow browning and crisping in these regions. Thus, the side walls which comprises a number of angled portions, as depicted by numerals 221, 222, 223, 224, of FIG. 7 for a four corner tray, can advantageously be covered in the immediate vicinity of the corners by upper microwave opaque layers 41, 42, 43, 44. Preferably, the opaque layers form a substantially triangular-shaped trapping region. In a variant of this, the opaque layers 41 to 44 are integrally formed with lid 4 that also has corners corresponding to the corners of the tray, as shown in FIGS. 7 and 7A. The rest of the lid is made of a microwave transparent material. The lid would remain in place during thawing and heating in the microwave oven. FIG. 7B illustrates another variant wherein the opaque layers 41–44 are additional layers secured to a transparent lid 4 in an adjacent configuration.

Figure 13:
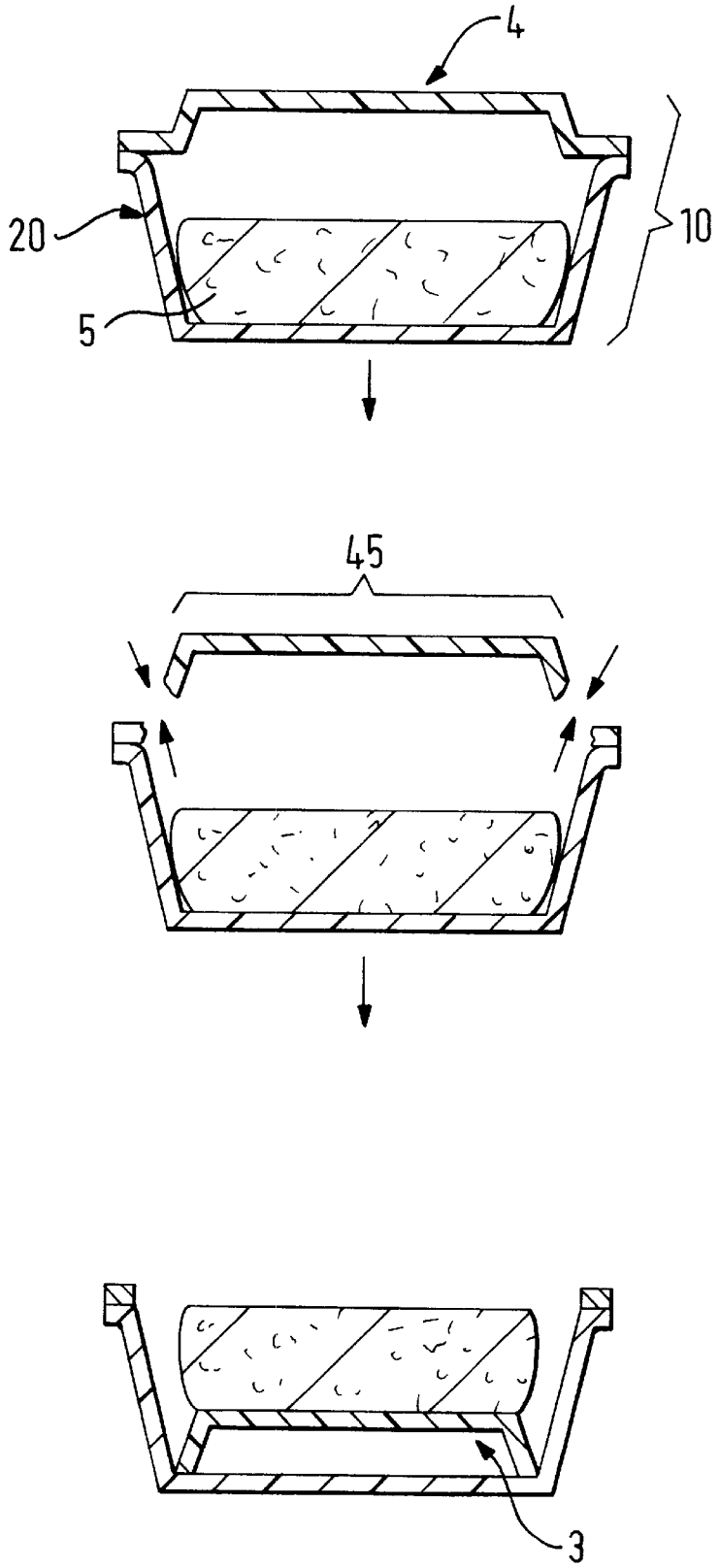
FIG. 13 is a vertical cross sectional view of a container according to another embodiment of the invention.

FIG. 13 shows another embodiment of the container 10 of the invention having a tray 20 and a lid 4 that closes the tray 20. In this embodiment, the lid is adapted to serve as the support means after the container has been opened. The lid consists of a protruding portion 45 that can be separated from the rest of the lid and then positioned within the cavity of the tray to form the support means 3 for the frozen food product. The protruding portion 45 of the lid is, for example, a plate-like part 47 with a peripheral edge 48 extending downwardly from the plate-like part so as to maintain a predetermined constant spacing between the frozen product and the bottom of the tray. The portion of the lid 45 is made of a material that is transparent to microwaves. The tray 20 is also made according to the previously explained requirements of the invention. The lid may be attached to the tray by any suitable means, such as, but not limited to, thermosealing, adhesion, and mechanical connections. Preferably, the portion of the tray 45 is detachable from the rest of the tray by independent attaching means.

Figure 14:
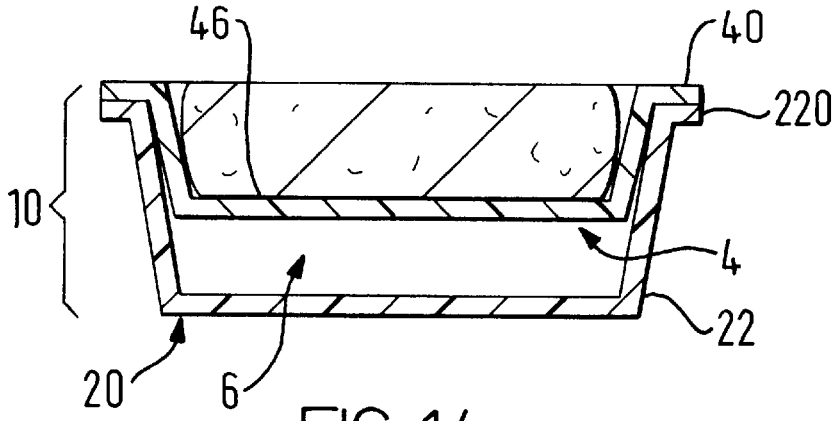
FIG. 14 is a diagram depicting a variant of the container of FIG. 13.

In FIG. 14, the container 10 comprises a tray 20 containing the food product and a lid 4 that closes the tray as in the FIG. 13. The lid is made of microwave-transparent material and can be separated from the tray 20 and turned up side down to fit into the tray 20. The lid is shaped so that it forms a cavity 46 for receiving the food product 5 when it is turned up side down to fit into the tray 20. The food product 5 is transferred from the tray 20 to the cavity of the lid 4. The tray provides a firm support for the lid preferably by means of side edges 220 protruding outwardly from the side wall of the tray that abut with the side edges 40 of the lid 4 in a complementary manner. The lid is sized so as to leave a predetermined free space 6 when the lid is fitted within the tray 20. As the tray comprises a reflective sidewall 22 that entirely surrounds the lid when it is placed in the tray 20 in a reversed position, the microwave radiation is shielded laterally and reflected inside the container in the direction of the food product. The tray 20 is preferably a unitary structure and made of aluminum-based material whereas the lid is preferably a relatively rigid or semi-rigid food-acceptable plastic that is transparent to microwaves. These embodiments have a reduced number of elements and provide a simple and economical means to provide the free space 6.

Figure 15:
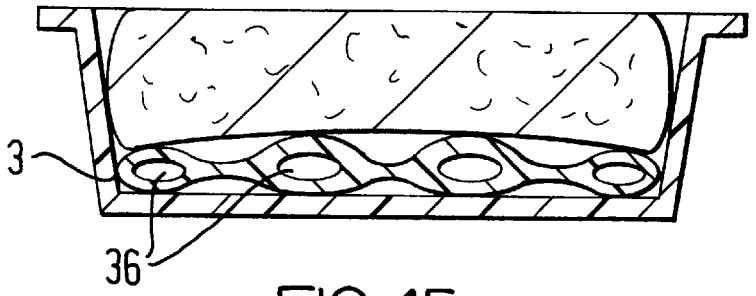
FIG. 15 is a vertical cross sectional view of a container according to another embodiment of the invention.
Figure 16:
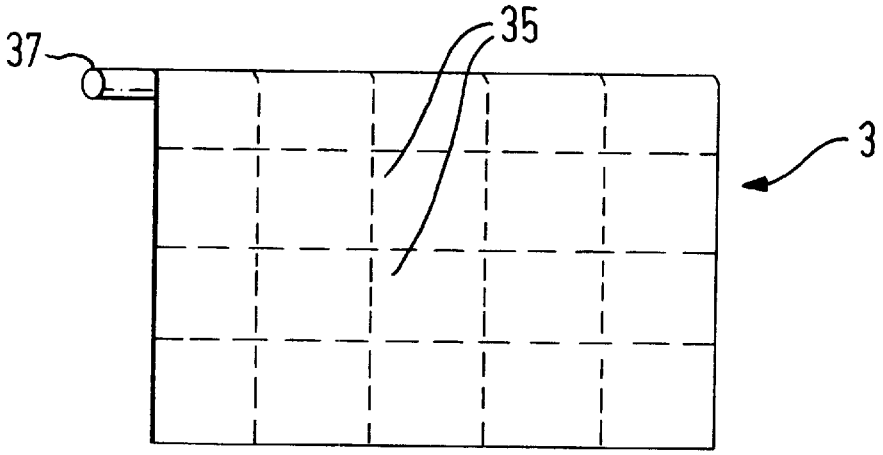
FIG. 16 shows the support element for the embodiment depicted in FIG. 15.

FIGS. 15 and 16 show another embodiment of the invention wherein the support means 3 comprises an inflatable support member capable of supporting the food product at a predetermined elevation with respect to the bottom of the tray. Preferably, the support member is a supple inflatable bag comprising a series of airtight cells 35 defining interior channels 36. The channels 36 are connected to allow air to pass from one cell to the other until the entire bag is properly inflated to a predetermined thickness. The bag is inflated by means of a valve 37 connected to the channels 36. The bag may is made of a material that is transparent to microwave radiation, such as, for example, a resilient plastic or rubber. In this embodiment the need to oversize the container to provide the free space 6 is avoided.

Figure 17:
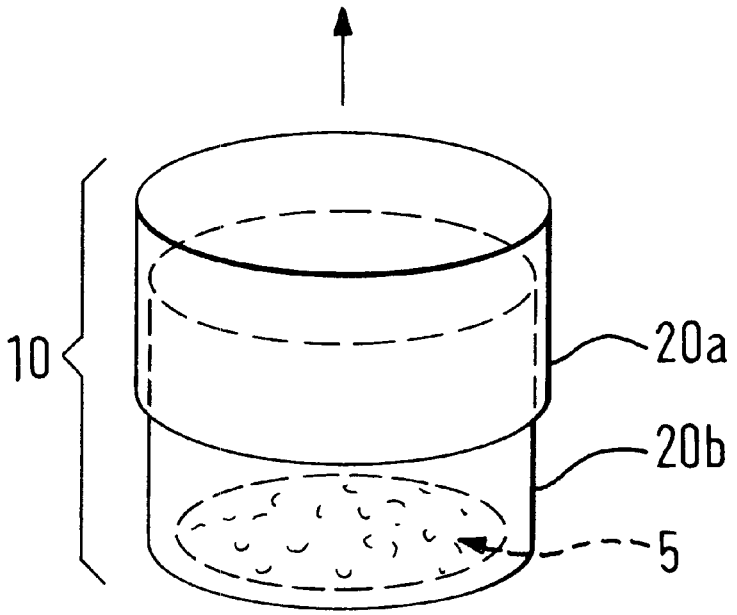
FIG. 17 illustrates another embodiment of the container of the invention in a closed configuration.
Figure 18:
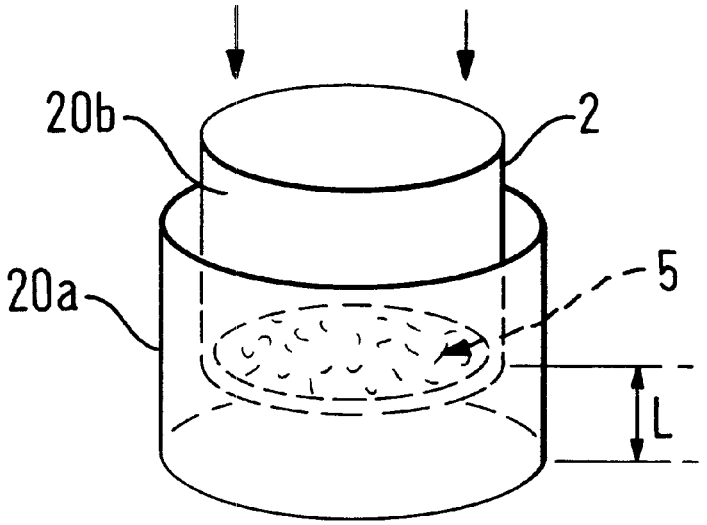
FIG. 18 shows the container of FIG. 17 positioned in a configuration ready for heating of the food product contained therein in a microwave oven.

FIGS. 17 and 18 illustrate another embodiment of the invention. The container 10 comprises an assembly of interchangeable tray members 20*a* and 20*b*. In FIG. 17, the container 10 has a lower member 20*b* in which the food product 5 is positioned. The lower member is made of a microwave-transparent material such as plastic or similar material. The lower member is closed by a larger upper tray member 20*a* that is made of a material that reflects microwaves. The upper tray member 20*a* has a sidewall extending downwardly which engages externally with the side wall of the lower tray member 20*b*. In this configuration, the container is preferably assembled and sealed in such a way that it is obvious if the container has been tampered with. When reheating the food product the upper member is opened and then reversed to fit with the lower member. As the reflecting member 20*a* is larger than the microwave-transparent member 20*b*, it provides a proper shield against the microwave radiation below and partly on the side of the food product. Support means such as an inner shoulder or small evenly distributed corrugations (not illustrated) may be used to maintain the predetermined elevation of the food product with respect to the bottom portion of the reflecting member 20*a* by limiting the depth of the microwave-transparent member 20*b* within the reflecting member 20*a*.

The invention is particularly useful for reheating large size containers, i.e., containers with a capacity of more than about 1 liter. Smaller containers, such as those adapted for reheating single portion frozen meals in domestic ovens, however, also benefit from the invention.

The container of the invention is not limited to reheating frozen foods and may also be used, for example, to heat or thaw non-frozen meals such as chilled products or to heat shelf stable food products that are at ambient temperature.

The invention also relates to a method for reheating as food product using the container of the invention wherein the food product has a sufficiently large upper surface exposed to the microwave radiation to allow an amount of microwave radiation to enter the food product and heat the food product. The container includes a free space having a vertical distance L between the bottom of the food product and the bottom of the container. The container is provided with a continuous shielding arrangement on at least a part of the container that corresponds to the external limits of the free space so as to produce a total reflection of the microwave beams toward the food product. The food product is then exposed to microwave energy for a sufficient time to cook the food product.

EXAMPLES

The invention is further defined by reference to the following examples describing in detail the preparation of the container for microwave cooking according to the invention. The examples are representative, and they should not be construed to limit the scope of the invention in any way.

Microwave reheating trials performed according to the embodiment depicted in FIG. 6, on frozen lasagna products, demonstrate the superior heating that is obtainable with the container of the invention. Glass beads, 10 mm in diameter, were used to obtain a height elevation of the product with respect to the bottom surface of an aluminum tray. In addition, the four corners of the aluminum tray were covered with aluminum patches having a triangular shape with side lengths, along the edges of the tray, being about 6.5 cm. The reason for the patches was to increase the reheating regime of all the lasagna components, including the bechamel sauce, in the corners. The frozen lasagna weighed about 1 kg. The tray had a rectangular configuration with the dimensions of 23 cm×17 cm×3.5 cm. The reheating trials were carried out using a Panasonic Genius NN-6858 side-fed microwave oven, equipped with a turntable and delivering a power output of 720 Watts.

Figure 9:
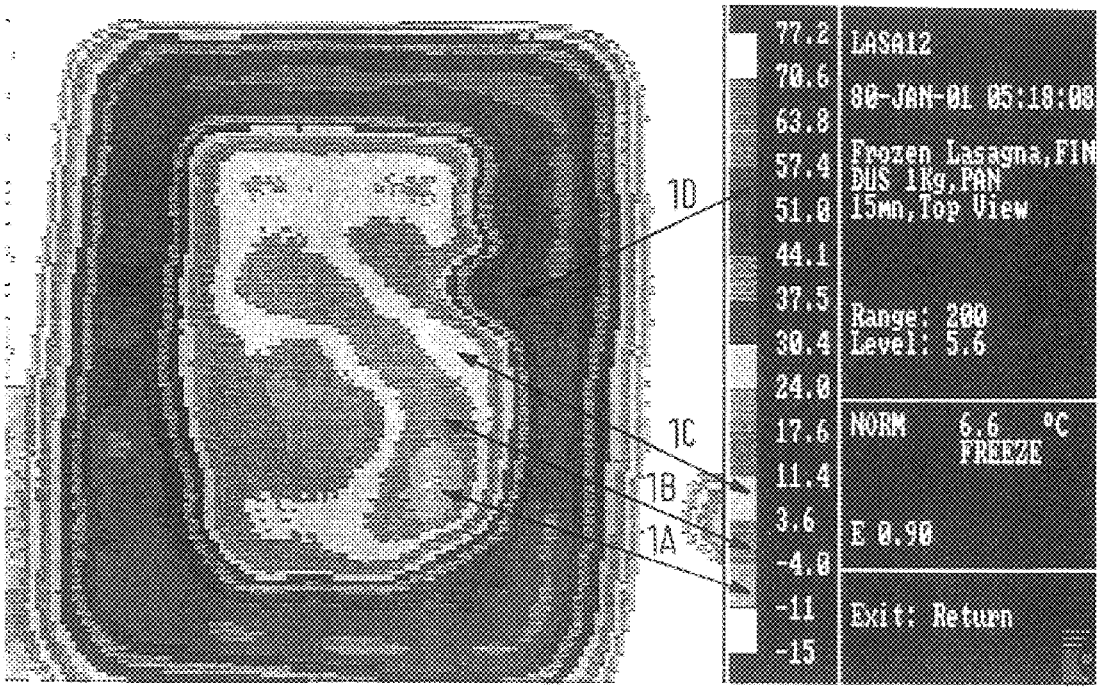
FIG. 9 is a thermograph diagram of the heat distribution in a food product that has been exposed to microwave radiations from above in a conventional microwave transparent tray for 15 minutes.

For comparison purposes, FIG. 9 shows a thermogram of lasagna reheated in a conventional microwave transparent tray for 15 minutes using the Panasonic microwave oven. The thermogram was obtained with an infrared camera and depicts the overall temperature distribution of the upper surface of the product. FIG. 9 shows highly contrasted temperature gradients with very low temperatures in the middle of the lasagna product (1A) and hotter regions in the vicinity of the periphery of the product (1D). Between the middle and the periphery of the product, the temperatures varies in a substantially gradual relationship. Therefore, after 15 minutes, the core of the lasagna product is still not at the right temperature while the edges have begun to heat.

Figure 10:
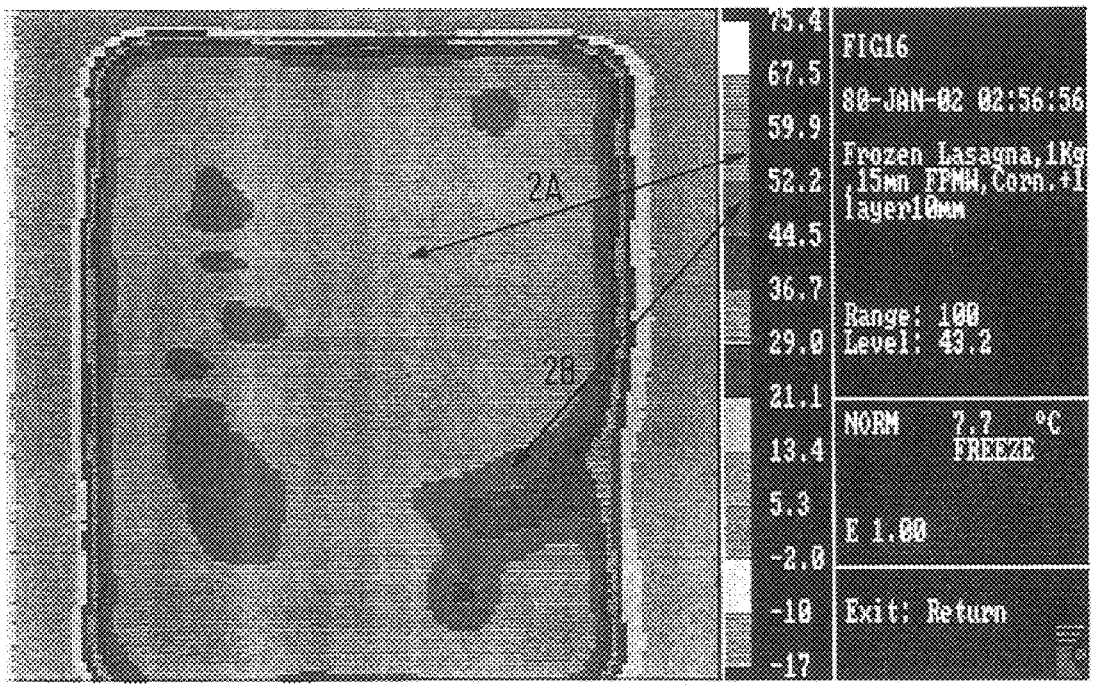
FIG. 10 is a thermograph diagram of the heat distribution in a food product that has been exposed to microwave radiations from above in a container of the invention for 15 minutes.

FIG. 10 shows a thermogram of a product heated for 15 minutes in a container of the invention with 10 mm elevation of the free space. The large cold spot has completely disappeared and the temperature distribution on the top surface of the product is substantially uniform. A large warm zone 2A at about 60° C. covers a major part of the upper surface of the food product after 15 minutes in the microwave oven.

Figure 11:
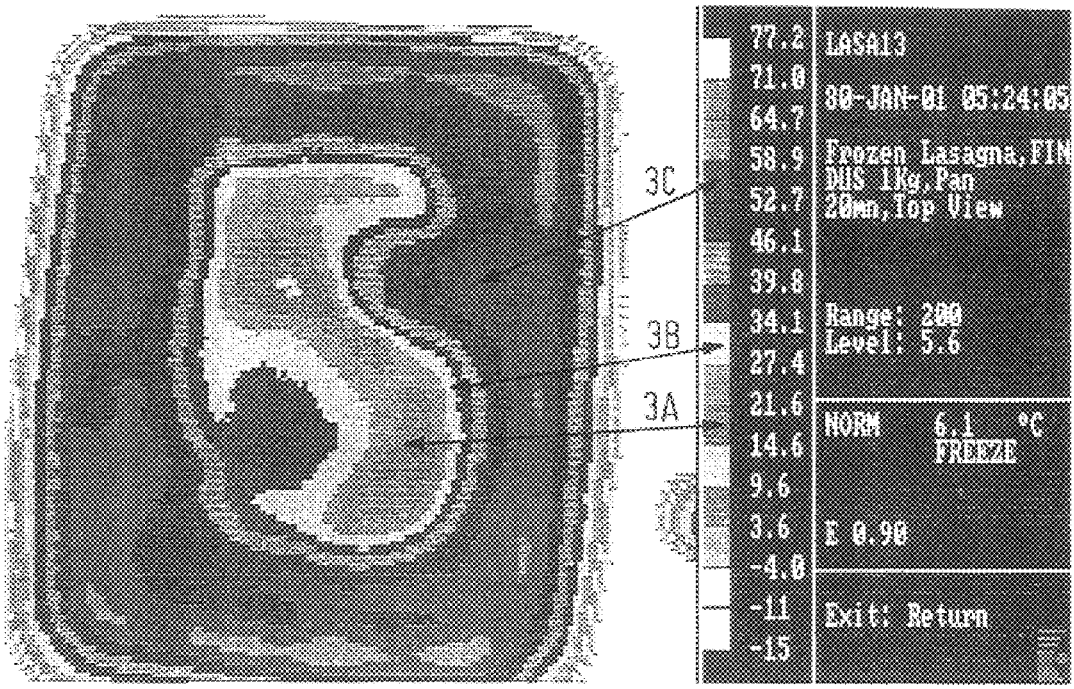
FIG. 11 is a thermograph diagram of the heat distribution in a food product that has been exposed to microwave radiations from above in a conventional microwave transparent tray for 20 minutes.
Figure 12:
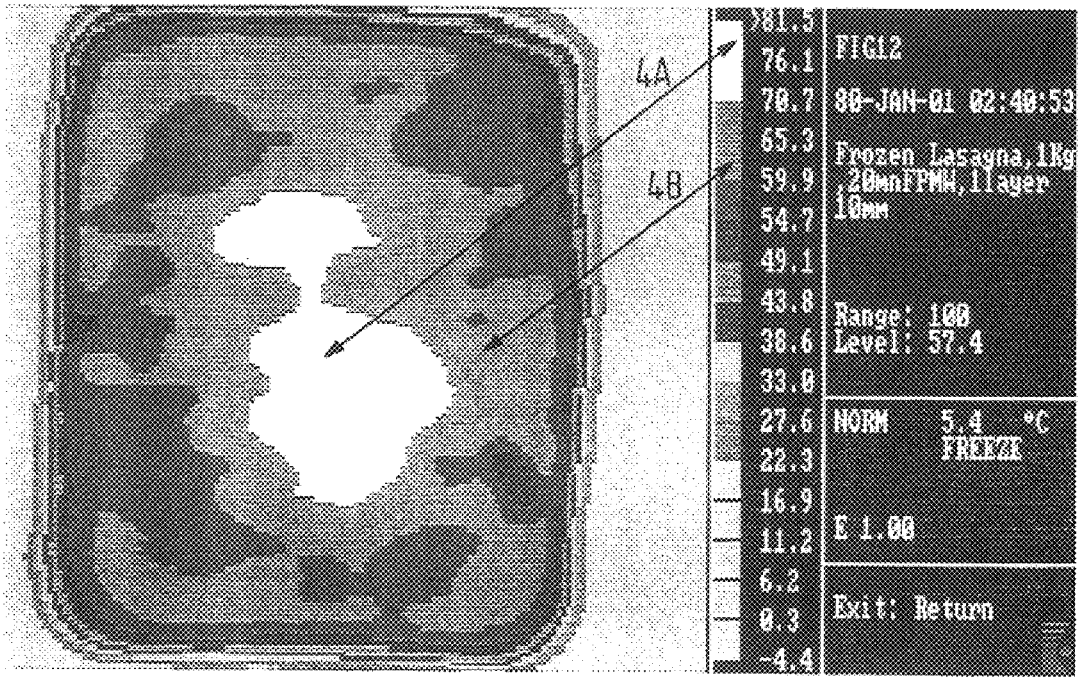
FIG. 12 is a thermograph diagram of the heat distribution in a food product that has been exposed to microwave radiations from above in a container of the invention for 20 minutes.

FIG. 11 illustrates a thermogram of the product after 20 minutes of heating in the Panasonic oven using a conventional microwave-transparent container. The thermogram still shows a highly varied temperature gradient with a centered cold spot (3A) at a temperature of only about 15° C. In contrast, FIG. 12 illustrates a thermogram of the product cooked in the container of the invention. This thermogram shows a large hot spot (4A) at a temperature of about 81.5° C. in the center of the surface of the lasagna. In fact, after only 12 minutes of heating in the container of the invention, the upper layer of the lasagna starts to expand and to form some "waving". After 15 min heating the upper parts of these "waves" start burning. This provides a product that has a browned and even slightly burnt top surface that is visually very appealing.

Pertinent microwave heating parameters are provided in Table I for a lasagna that was heated for 15 minutes in the Panasonic oven using the tray of the invention and glass beads having diameters of 5, 7, 8, 10 and 12 mm. Also provided in Table I are the parameters for an aluminum tray with no elevation (i.e., the lasagna is in direct contact with the bottom of the tray). For comparison purposes, the parameters for a lasagna reheated for 30 minutes in plastic tray are provided. This corresponds to substantially complete microwave heating.

TABLE 1

| | ΔTm/Δt (° C./min) | σ | TI (° C.) |
|---|---|---|---|
| Comparative | | | |
| Lasagna in Plastic Tray | 3.03 | 8.3 | 41.5 |
| Aluminum Tray. No elevation | 2.87 | 3.6 | −2.5 |
| Invention | | | |
| Elevation 5 mm | 4.27 | 2.6 | 13.5 |
| Elevation 7 mm | 4.88 | 2.8 | 28.5 |
| Elevation 8 mm | 5.22 | 2.5 | 44.8 |
| Elevation 10 mm | 5.65 | 2.2 | 55.2 |
| Elevation 12 mm | 5.35 | 2.9 | 50.8 |

The apparent mean heating rate, "ARH" and formulated by ΔTm/Δt where ΔTm=Tm−Ti, wherein Tm is the mean temperature on the top surface as measured from the thermogram and Ti is the initial temperature which is −20° C., and At is the heating time (30 minutes for the plastic tray and 15 minutes for the aluminum trays).

σ is the calculation of standard deviation of the temperature distribution of the upper surface of the lasagna in the thermograms. A low value of σ, indicates a more uniform temperature on the top surface of the product.

TI is the lowest temperature of the product measured after 15-minutes of heating (30 minutes in the plastic tray). The TI was measured using fiber-optic probes located about 1.5 cm beneath the center of the coldest areas detected on the thermogram.

It is obvious that using an aluminum tray, with or without elevation of the lasagna, leads to a uniform heating pattern on the top of the product, as indicated by the a values which are reduced by a factor of about 4 (8.2 to 2.2). The ARH (Apparent Heating Rate) is also decreased by the use of an aluminum tray compared to a plastic tray. The ARH, however, shows a steep increase with increasing elevation of the lasagna with respect to the bottom surface of the aluminum tray. An elevation of about 10 mm seems to be the optimal elevation for this product having a thickness of about 28 mm. For elevations above 10 mm, the trend of improvement in the ARH appears to be slightly reversed for this product.

For all tests performed using the aluminum tray the temperature pattern obtained was far more uniform compared to a plastic tray. When there is no elevation of the lasagna product in the aluminum tray, however, or when the elevation is far away from the optimal elevation, the deepest parts of the lasagna remain frozen and only starts to slowly thaw after an extended reheating time. Close to the optimal elevation, however, the interior of the lasagna starts to thaw at the beginning of the microwave reheating process and the overall microwave heating rate is drastically improved.

Reheating the lasagna in the container of the invention wherein the elevation of the lasagna with respect to the tray bottom surface is at an optimal value of about 10 mm provides complete reheating of 1Kg of lasagna, having a thickness of about 28 mm, in about 15 to 16 minutes. This corresponds to a reduction in the microwave reheating time for the lasagna of about 50 to 54 percent.

The invention described and claimed herein is not to be limited in scope by the specific embodiments herein disclosed, since these embodiments are intended as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

What is claimed is:

1. A food-filled container for cooking food in a microwave oven comprising a tray comprising a bottom wall and a continuous side wall attached to the bottom wall and extending upwardly from the bottom wall, wherein the bottom wall and side wall define an interior cavity, and support means comprising a material that is substantially transparent to microwave radiation to support a food, said food having a top surface and a bottom surface in the interior cavity in an elevated position above the bottom wall, wherein the bottom surface of the food and the bottom wall are separated by a distance and the bottom wall of the tray, the bottom of the food, and at least part of the side wall define a free space underneath the food, wherein the bottom wall and at least part of the side wall that defines the free space are constructed to reflect substantially all microwave radiation that passes through the food back toward the food, and wherein part of the side wall that extends upwardly above the free space at least to the upper surface of the food and is constructed to reflect microwave radiation to more quickly and uniformly heat the food.

2. The container of claim 1, further comprising a lid.

3. The container of claim 2, wherein the lid is made of a material that is transparent to microwave radiation.

4. The container of claim 3, wherein at least a portion of the lid is adapted to serve as the support means after the container has been opened.

5. The container of claim 4, wherein the lid comprises a flat member and a peripheral edge that extends downwardly from the flat member and fits inside the interior cavity with the peripheral edge contacting the bottom wall of the container.

6. The container of claim 3, wherein the lid comprises a flat member, a peripheral edge that extends downwardly from the flat member so that it forms a cavity for receiving the food when it is turned upside down, and a side edge associated with the peripheral edge and protruding outwardly from the cavity so that the side edge abuts with and is supported by the side wall of the tray and the flat member of the lid and the bottom wall are separated by a distance to provide the free space when the lid is turned upside down and placed in the tray.

7. The container of claim 1, wherein the distance between the bottom surface of the food and the bottom wall is at least about 2 millimeters but less than about 20 mm.

8. The container of claim 1, wherein the bottom wall and side wall part that defines the free space is constructed of a metallic material.

9. The container of claim 8, wherein the metallic material comprises aluminum or an aluminum alloy.

10. The container of claim 1, wherein the tray is a single unit made entirely of a metallic material that reflects microwave radiation.

11. The container of claim 10, wherein the tray is made of aluminum or an aluminum alloy.

12. The container of claim 1, wherein the tray comprises a multilayer arrangement with at least one layer being a metallic layer that reflects microwave radiation.

13. The container of claim 1, wherein the support means comprises a flat member for receiving the food and at least one spacing member between the bottom wall and the flat member.

14. The container of claim 13, comprising a plurality of spacing members which are substantially evenly distributed and attached to the flat member.

15. The container of claim 13, wherein the at least one spacing member is attached to the tray.

16. The container of claim 13, wherein the spacing member comprises a peripheral shoulder on the side wall directed toward the interior cavity onto which the flat member is positioned.

17. The container of claim 13, wherein the spacing member includes a plurality of glass or plastic marbles that directly contacts the food.

18. The container of claim 1, wherein the side wall has one or more corners that are angled and further comprising a microwave opaque material that spans the side walls at the corners to concentrate the microwave radiation in the corners.

19. The container of claim 18, further comprising a lid to provide the opaque material wherein the lid has a main central portion made of a material that is transparent to microwave radiation and microwave opaque portions are attached thereto.

20. The container of claim 1, wherein the support means is collapsible.

21. The container of claim 20, wherein the support means comprises an inflatable bag comprising a series of air cells that define interior channels that can be inflated with air before cooking.

22. The container of claim 1 wherein the cavity has a size of at least about 1 liter, and wherein the entire sidewall is constructed to reflect microwave radiation.

23. The container of claim 1 wherein the tray is a lid that in one position covers the support means and the food and in an inverted position forms the free space beneath the food.

24. The container of claim 23, wherein the support means includes a side wall to form the interior cavity and the support means is configured to have a smaller periphery that than the side wall of the lid, and further comprising spacer means for limiting the depth that the support means can be inserted into the lid.

25. The container of claim 23, wherein the spacer means is a shoulder associated with one of the side walls.

* * * * *